United States Patent [19]

Arnell

[11] Patent Number: 5,049,859

[45] Date of Patent: Sep. 17, 1991

[54] WATER ENTRY ALARM SYSTEM

[75] Inventor: Clifford G. Arnell, Elizabeth, Colo.

[73] Assignee: Karla J. Roffee, Phoenix, Ariz. ; a part interest

[21] Appl. No.: 594,401

[22] Filed: Oct. 9, 1990

[51] Int. Cl.[5] ..... G08B 21/00

[52] U.S. Cl. ..... 340/573; 340/529; 340/566; 340/572

[58] Field of Search ..... 340/572, 573, 566, 529

[56] References Cited

U.S. PATENT DOCUMENTS

| | | | |
|---|---|---|---|
| 3,486,166 | 12/1969 | Campana et al. | 340/566 |
| 3,810,146 | 5/1974 | Lieb | 340/573 |
| 3,925,773 | 12/1975 | Green | 340/529 |

*Primary Examiner*—Jin F. Ng
*Assistant Examiner*—C. Oda
*Attorney, Agent, or Firm*—LaValle D. Ptak

[57] ABSTRACT

A pool safety alarm system includes a water-activated sonar transmitter adapted to be worn on the body of a non-swimmer for continuously transmitting low frequency audio signals upon immersion of the transmitter. An underwater microphone or hydrophone is located within the pool and is connected to a receiver circuit having a band pass filter connected to a monostable multivibrator for supplying signals to an alarm. Whenever signals within the pass band of the filter are received by the hydrophone, these signals trigger the monostable multivibrator from its stable state to its astable state. The astable state of the multivibrator operates the alarm. When signals within the pass band frequency of the filters are received by the hydrophone from sources other than the water-activated transmitter, such signals typically are momentary or intermittent. These signals cause the monostable multivibrator to be triggered to its astable state and then allowed to time out; so that the alarm produces a short duration alarm signal. Whenever the signals received by the hydrophone are caused by the water-activated transmitter, the signals are continuous; and the monostable multivibrator is continuously retriggered; so that the alarm produces a continuous alarm signal.

10 Claims, 1 Drawing Sheet

WATER ENTRY ALARM SYSTEM

BACKGROUND

In the United States and many other countries, large numbers of swimming pools are in use and currently are being built. While some of these pools are "public" pools where use is restricted to time periods when lifeguards are present, many such pools are located in the yards of private homes. These private pools, in particular, present a constant danger to non-swimmers, particularly small children. Unprotected swimming pools are a significant cause of the loss of life through drowning of small children. The problem is sufficiently severe that many local authorities now require protective fencing around such pools and between the pool and any home with which it is associated.

Even though protective fencing currently is legislated in most areas for new pool construction, many older swimming pools exist which do not have protective fencing. Even with such fencing, however, small children frequently enter the pool area through an unlatched gate, or find some other way to surmount the fence to reach the pool. Toddlers in particular are difficult to protect from the dangers of swimming pools since they move quickly, often ignore warnings and are extremely curious.

Various devices and systems have been developed for setting off an alarm when a person or some other object enters a pool during the time the alarm is activated. Systems of this type, which do not include any device or portion worn by a person, are disclosed in the patents to Wolf U.S. Pat. No. 4,510,487; Woolley U.S. Pat. No. 4,571,579; Baker U.S. Pat. No. 4,604,610; and Dunegan U.S. Pat. No. 4,747,083. The devices shown in the Wolf and Woolley patents are activated by wave action in the pool. A sensor detects the wave action and the sensed wave action is converted electrically into a signal which is used to trigger an audible alarm.

The device disclosed in the Baker U.S. Pat. No. 4,604,610 employs a hydrophone, located beneath the surface of the pool and coupled with a sensor, to respond to vertical wave motion of the pool water beneath the surface impacting the hydrophone transducer. The hydrophone is electrically connected with an amplifier circuit for triggering an alarm in response to wave motion which exceeds a preestablished threshold.

A different approach is taken in the Dunegan U.S. Pat. No. 4,747,085. In Dunegan, a transmitter is mounted below the surface of a swimming pool to continuously transmit ultrasonic sound waves through the body of water. An underwater receiver is positioned to detect the sound waves; and the receiver produces an electrical signal which is monitored. Whenever movement of a person in the pool occurs, the received ultrasonic sound waves are altered, causing an alteration of the electrical signal produced by the receiver. This altered signal then is used to actuate an alarm.

A disadvantage which is common with all of the devices of the patents discussed above is that the alarm is triggered any time any person enters the water of the pool or swims in the pool. Consequently, when normal use of the pool is desired, the alarms must be deactivated or turned off. Frequently, the pool owner or user will forget to re-activate the alarm or turn it back on after use of the pool has taken place. Even during periods of normal pool use, for example when a family is actively engaged in water activities, in and out of the pool, small children frequently and readily can slip unnoticed into the water. If the alarm is turned off, such a child may not be detected in time to save the child's life. Even if the alarm is turned on, small children frequently slip into the water with little or no wave motion; so that to be effective in protecting against the drowning of such children, the alarm devices must be extremely sensitive. When the sensitivity of such alarms is increased, false alarm conditions frequently are produced. If a sufficient number of false alarm operations take place, most persons disconnect the alarm system; and its intended purpose is thereby defeated.

Attempts to overcome the disadvantages of the patents discussed above have been made by attaching some type of water-activated switch or alarm directly to a person to be protected. Four patents which are directed to this general type of pool or water safety alarm are the patents to Antenore U.S. Pat. No. 4,079,364; Moura U.S. Pat. No. 4,549,169; Sackett U.S. Pat. No. 4,620,181; and Boe U.S. Pat. No. 4,714,914. All four of these patents are directed to water-activated switches of some type, which directly operate an alarm or activate a transmitter for transmitting a signal to an alarm whenever a switch is activated. In each case, the transmitter or activating portion is worn by the person being monitored. The manner in which the devices are operated and in which they are activated, differs, but all of them have this basic feature in common.

A somewhat different approach to monitoring the activity of a person in a body of water is disclosed in the patent to Bianco U.S. Pat. No. 3,786,406. The Bianco device includes an underwater sonar transmitter and an underwater sonar receiver in constant communication with one another. The person wearing the transmitter must periodically close a switch to keep it in operation. An alarm is sounded when the time interval between successive closures of the transmitter-activating switch exceeds some pre-established limit. Because of the necessity for constantly closing the transmitter switch, this device is not suitable for protecting small children or non-swimmers who might accidently fall into a body of water. The Bianco device has utility in monitoring the activity of a diver or underwater swimmer.

A system which is perhaps of most utility for protecting nonswimmers, such as babies and toddlers in particular, is disclosed in the patent Lieb U.S. Pat. No. 3,810,146. The system of this device includes a portable ultrasonic (sonar) transmitter which is attached to the clothes of the person to be protected, or otherwise attached to the body of such a person. The transmitter is activated for operation upon immersion in water. An underwater receiver responds to the ultrasonic wave generated by the transmitter to operate an alarm upon receiving the transmitted signal. The nature of the device disclosed in the Lieb patent is such that the alarm can be left activated or turned on at all times, including times when other swimmers are using the pool. Since the frequency of the mechanical wave which is produced by the transmitter is ultrasonic, the danger of "false alarms" also is reduced. A problem with the use of an ultrasonic transmitter/receiver, however, is that ultrasonic waves are "directional"; so there is a danger that an alarm condition could exist without the receiver detecting the condition in sufficient time to actuate the alarm.

It is desirable to provide an improved pool safety alarm system which overcomes the disadvantages of the prior art, which is effective in use, which is not subject to false alarms, and which is capable of providing an indication, in a stand-by mode, that it is functioning properly.

SUMMARY OF THE INVENTION

It is an object of this invention to provide an improved water-entry alarm system.

It is another object of this invention to provide an improved alarm system to indicate the entry of a non-swimmer into a body of water.

It is an additional object of this invention to provide an improved swimming pool safety alarm system.

It is a further object of this invention to provide an improved pool safety alarm system for operating an alarm upon the entry of a non-swimmer into the water of a pool and which provides periodic indications, in a stand-by mode of operation, that the system is properly activated.

In accordance with a preferred embodiment of this invention, a pool safety alarm system provides warning of the entry of a nonswimmer into the pool. A water-activated transmitter is worn on the body of the non-swimmer and continuously transmits a signal having pre-established characteristics whenever the transmitter is immersed in water. A signal sensor is located in the body of water or pool, under the water surface, to sense the signals produced by the transmitter. An electrical interconnection is made between the sensor and a signal processing circuit which is used to activate the alarm. The signal processing circuit operates to continuously operate the alarm when the transmitter signals are detected by the sensor. In a stand-by mode of operation, the alarm is momentarily operated in response to signals having at least some of the characteristics of the transmitter signals, but which are not continuously produced. This permits a constant monitoring of the correct operation of the system.

DETAILED DESCRIPTION

Figure 1:
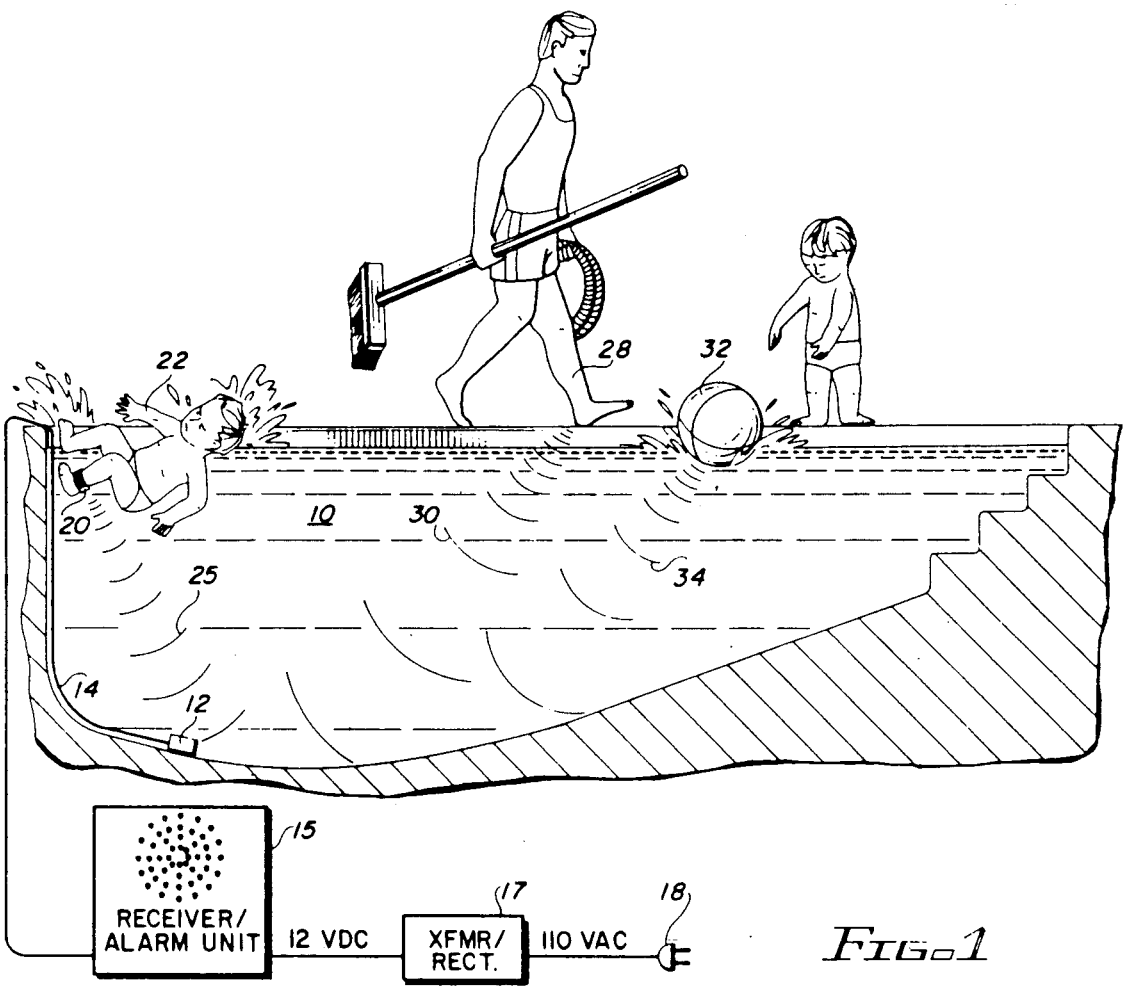
FIG. 1 is a diagrammatic representation of a preferred embodiment of the invention.

Reference now should be made to the drawing, in which the same reference numbers are used in both figures to designate the same or similar components.

FIG. 1 shows a cross-sectional view of a typical swimming pool 10 which is filled with water. In accordance with a preferred embodiment of the invention, a hydrophone receiver 12 is located beneath the surface of the water, and is illustrated as resting on the bottom of the pool 10. The hydrophone receiver 12 is attached by means of a low voltage wire 14 to a receiver/alarm unit 15. The alarm unit 15 is supplied with 12 volt direct current operating current from a transformer rectifier unit 17, which in turn is supplied with 110 volt alternating line current from any suitable receptacle through a plug 18. Since a low-voltage direct current is used in the system, the wire 14 and the submerged hydrophone 12 do not present any electrical hazard to persons using the pool 10.

The receiver/alarm unit 15 is continuously activated; so that the hydrophone 12 continuously "listens" for signals in the frequency range processed by the receiver/alarm unit 15. The particular signals which are of interest are those which are produced by a modulated transmitter 20, shown in block diagram form in FIG. 2, and illustrated as being attached to a band around the ankle of a child 22. The transmitter may use any suitable water-activated switch (not shown) for activating it and, typically, is a self-contained, battery-operated unit.

Figure 2:
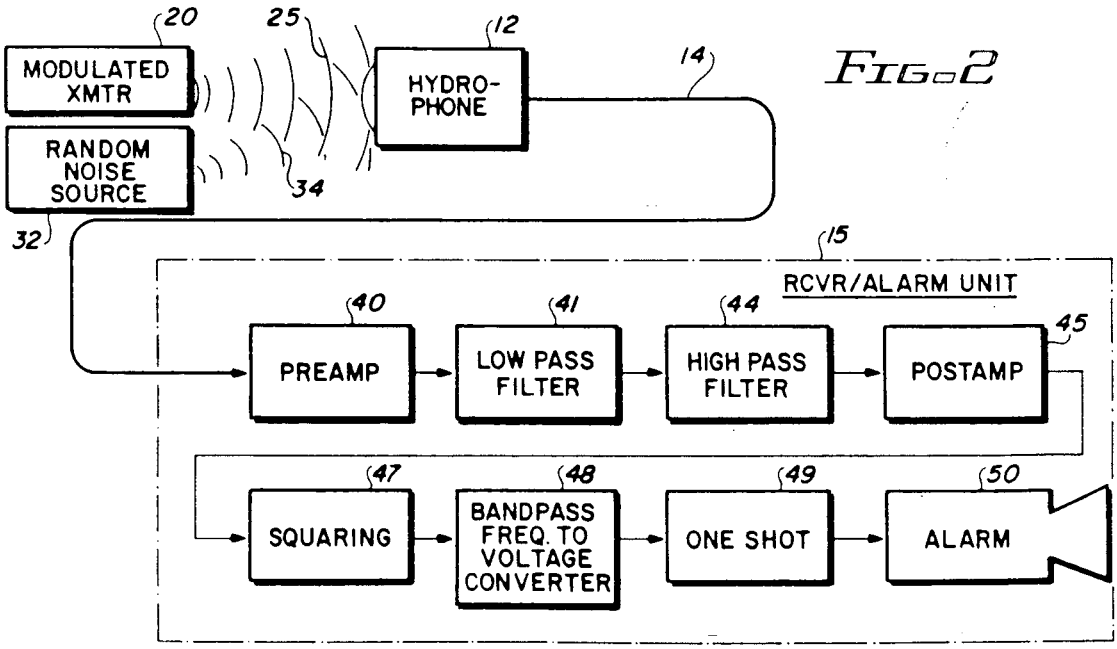
FIG. 2 is a block circuit diagram of the system shown in FIG. 1.

So long as the transmitter 20 is dry, no signals are produced by it. If a child 22, wearing the transmitter 20, however, should fall into the pool, as illustrated in FIG. 1, the water-activated operating contacts for the transmitter 20 are closed, causing it to produce signals 25 having predetermined characteristics. Specifically, in the embodiment of the invention which is shown in FIGS. 1 and 2 of the drawing, the signals produced by the battery-operated modulated transmitter 20 have a frequency of 3KHz (preferably a frequency range from 1KHz to 10KHz). These are low frequency, high voltage audio signals, and are transmitted in the form of mechanical waves 25 through the water from the transmitter 20. Since low frequency signals are used, the signals 25 have an omni-directional quality to them. Thus, the hydrophone 12 responds to these signals wherever they may be produced in the pool, irrespective of the orientation of the output producing device located within the transmitter 20. The signals produced by the transmitter 20 also may be further characterized by transmitting them in intermittent spaced bursts, if desired. A significant improvement, however, results in the utilization of as low a frequency as possible, since low frequencies are much less directional than higher frequencies.

The transmitter 20 is a sonar type transmitter, and produces either continuous signals or successive bursts of signals. Such transmitters are well known; and the transmitter 20, which is employed as the sonar transmitter for the signals 25, may be of any suitable type capable of producing such signals.

As shown in FIG. 2, the signals 25 produced by the transmitter 20 are received by the hydrophone 12 and are supplied over the lead 14 to a preamplifier 40. The output of the preamplifier 40 is supplied to a low-pass filter 41 which, typically, has a pass band of from zero to 10KHz. The output of the low-pass filter 41 then is supplied to a high-pass filter 44, which passes frequencies above 1 KHz. Between them, the filters 41 and 44 constitute a bandpass filter having a frequency range of 1KHz to 10KHz. Clearly, the 3KHz signal 25 produced by the transmitter 20 is centered in this pass band. The output of the filter 44 is amplified by a post amplifier circuit 45; so that the total gain of the system from the preamplifier 40 through the amplifier 45 is approximately 72 db. Obviously, any suitable gain, depending upon the nature of the components, may be used.

The post amplifier 45 supplies the narrow band signal to a squaring circuit 47 of a conventional type to transform the sinewave signals, which are applied to it, into square-wave signals at the detected frequency. The output of the squaring circuit 47 then is supplied to a bandpass frequency-to-voltage convertor 48, which supplies a substantially binary signal at its output, in accordance with the nature of the signals supplied to it from the circuit 47.

In the absence of signals in the frequency pass band of the system, the output of the frequency-to-voltage convertor 48 is one binary value (binary "0"). Whenever signals are received, the squaring circuit 47 supplies those signals to the circuit 48, which then switches to the other of two binary values (binary "1") as an indication of a received signal. The output of the circuit 48 remains at its binary "1" value so long as signals continue to be applied to it from the squaring circuit 47.

Whenever the output of the frequency-to-voltage convertor 48 changes from a binary "0" to a binary "1," the signal transition comprises a trigger pulse applied to the input of a re-triggerable monostable multivibrator or one-shot 49 to trigger the multivibrator 49 from its stable state (binary "0") to its astable state (binary "1"). The timeout period of the astable state of the monostable multivibrator 49 is relatively short (approximately 0.1 seconds) and whenever the monostable multivibrator 49 is triggered to its astable state, a signal is applied to an alarm 50 to energize the alarm. Typically, the alarm is a loudspeaker which produces a loud warning signal any time it is activated.

If the signal supplied to the monostable multivibrator 49 is a result of the transmitted signal 25 produced by the modulated transmitter 20 worn by the child 22, a continuous signal or continuous intermittent short bursts of signal are processed by the circuit 48 to apply continuous binary "1" signal to the input of the multivibrator 49, or to apply successive intermittent trigger signals (if the signal 25 is an intermittent modulated series of bursts of signals) to the input of the monostable multi-vibrator 49. If the signals are continuous, the multivibrator 49 is prevented from reverting from its astable state back to its stable state; so that the alarm 50 is continuously activated. Similarly, if bursts of signals 25 are supplied from the frequency-to-voltage convertor 48 to the monostable multivibrator 49, the time out period of the multivibrator 49 is selected to be slightly greater than the time between successive bursts of the signals; so that the multivibrator 49 is continuously retriggered before it times out. This occurs as long as the signal 25 is produced by the transmitter 20. Consequently, the alarm 50 is operated continuously for so long as the transmitter 20 is operated. A person hearing the alarm immediately would rush to the pool to remove the child 22 who is wearing the transmitter 20.

An important feature of the invention is the ability for persons in the vicinity of the pool 10 and the alarm 50 continuously to monitor the proper operation of the entire system. Since the frequency of the transmitted signal 25 is 3KHz, a low audio frequency, other activities result in random noises at this frequency or in the frequency range of the bandpass filter comprising the filters 41 and 44. For example, a person 28 walking along the edge of the pool creates vibrations which are in this frequency range and which are shown by the waveform 30 in FIG. 1. These signals are received by the hydrophone 12 and are applied through the system to trigger the one-shot multivibrator 49, as described previously. The alarm 50 is then operated for the duration of the time out period of the astable state of the multivibrator 49. This results in a short "beep" or "chirp" of sound from the alarm 50. A steady sound production from the alarm 50 of relatively long duration, however, does not take place, since the sounds produced by a person 28 walking past the pool are not as closely spaced as those transmitted by the sonar transmitter 20, even when it is operated in a pulsed intermittent mode.

Similarly, if a ball 32 or other object falls into the pool, a sound wave 34 in the frequency range of 1KHz to 10KHz also is produced. This wave 34 from the random noise source 32 is picked up by the hydrophone 12 and results in one or more spaced-apart triggerings of the monostable vibrator 49 to produce the short term "beep" or "chirp" from the alarm 50.

By continuously leaving the system operative, as described, the alarm 50 periodically and randomly produces the short "beep" output signals which indicate the active operating state of the system and the proper operation of the system to persons in the vicinity of the alarm 50. These signals are not offensive, although they provide a positive and continuous monitoring indication of the proper working condition of the entire system.

The foregoing description of the preferred embodiment of the invention as illustrated in the drawing, is to be considered as illustrative and not as limiting of the invention. Any type of transmitter capable of producing the signals necessary for detection by the hydrophone may be used. The frequency range which has been selected is desirable, although signals in other frequency ranges may be employed without departing from the true scope of the invention. The particular circuit configuration which has been shown may be modified, so long as the operating characteristics are maintained. Although the alarm 50 has been described primarily as a loudspeaker alarm, visual alarm devices could be employed as well, either in place of or in conjunction with, the audible alarm 50. Various other changes and modifications will occur to those skilled in the art without departing from the true scope of the invention as set forth in the appended claims.

I claim:

1. A water-entry alarm system for providing warning of the entry of non-swimmers into a body of water including in combination:

water-activated transmitter means adapted to be worn on the body of a non-swimmer, said transmitter means continuously transmitting signals in the audible frequency range having predetermined characteristics whenever said transmitter means is immersed in water;

signal sensor means for location in a body of water for sensing signals of said predetermined characteristics;

an alarm; and signal processing means coupled between said signal sensor means and said alarm and responsive to signals of said predetermined characteristics sensed by said signal sensor means for operating said alarm in a first alarm mode continuously producing an audible alarm warning signal when said signals of said predetermined characteristics continuously occur, and for operating said alarm in a second monitoring mode to produce short term "beep" alarm signals when signals of said predetermined characteristics momentarily are sensed by said sensor means.

2. The combination according to claim 1 wherein said signal processing means includes monostable trigger means responsive to said sensor means and switched to an astable state for a predetermined finite time period for operating said alarm said finite time period setting the length of said short term "beep" alarm signals in said second monitoring mode of operation of said alarm.

3. The combination according to claim 2 wherein said monostable trigger means is switched from a first stable state to said astable state in response to the sensing of signals having said predetermined characteristics by said signal sensor means, such that the output of said monostable trigger means is maintained in said second astable state in response to the sensing of continuous signals having said predetermined characteristics to operate said alarm in said first alarm mode thereof and said monostable trigger means reverts back to said first stable state after said predetermined time period after being switched to said astable state by the momentary sensing of signals of said predetermined characteristics by said signal sensor means to cause said alarm means to operate in said second monitoring mode thereof.

4. The combination according to claim 3 wherein said signal sensor means comprises a hydrophone.

5. The combination according to claim 4 wherein said signals having said predetermined characteristics are signals having a frequency less than 10KHz.

6. The combination according to claim 1 wherein said signal sensor means comprises a hydrophone.

7. The combination according to claim 6 wherein said signals having said predetermined characteristics are signals having a frequency less than 10KHz.

8. The combination according to claim 7 wherein said signal processing means includes monostable rigger means responsive to said sensor means and switched to an astable state for a predetermined finite time period for operating said alarm, said finite time period setting the length of said short term "beep" alarm signals in said second monitoring mode of operation of said alarm.

9. The combination according to claim 1 wherein said signals having said predetermined characteristics are signals having a frequency less than 10KHz.

10. The combination according to claim 9 wherein said signal processing means includes monostable trigger means responsive to said sensor means and switched to an astable state for a predetermined finite time period for operating said alarm, said finite time period setting the length of said short term "beep" alarm signals in said second monitoring mode of operation of said alarm.

* * * * *